US009321551B2

(12) United States Patent
Lu et al.

(10) Patent No.: US 9,321,551 B2
(45) Date of Patent: Apr. 26, 2016

(54) CUP WITH INTEGRAL CLOSURE FLAPS RESTRICTING SPILLAGE

(71) Applicant: Hanpak Limited, County Laois (IE)

(72) Inventors: Wei Lu, Dublin (IE); Kenneth Duggan, Dublin (ID)

(73) Assignee: HANPAK LIMITED, County Laois (IE)

( * ) Notice: Subject to any disclaimer, the term of this patent is extended or adjusted under 35 U.S.C. 154(b) by 0 days.

(21) Appl. No.: 14/403,481

(22) PCT Filed: May 27, 2013

(86) PCT No.: PCT/EP2013/060889

§ 371 (c)(1),
(2) Date: Nov. 24, 2014

(87) PCT Pub. No.: WO2013/175020

PCT Pub. Date: Nov. 28, 2013

(65) Prior Publication Data

US 2015/0097026 A1 Apr. 9, 2015

(30) Foreign Application Priority Data

May 25, 2012 (IE) ..... S2012/0245

(51) Int. Cl.

| | |
|---|---|
| ***B65D 3/06*** | (2006.01) |
| ***B65D 3/20*** | (2006.01) |
| ***B65D 3/30*** | (2006.01) |

(52) U.S. Cl.
CPC .. *B65D 3/20* (2013.01); *B65D 3/06* (2013.01); *B65D 3/30* (2013.01)

(58) Field of Classification Search
CPC ..... B65D 3/06; B65D 3/20; B65D 3/30
USPC ..... 220/719, DIG. 5
See application file for complete search history.

(56) References Cited

U.S. PATENT DOCUMENTS

| | | | | |
|---|---|---|---|---|
| 3,313,447 | A * | 4/1967 | Spencer | 220/719 |
| 3,361,160 | A * | 1/1968 | Alper | 137/557 |
| 3,423,009 | A | 1/1969 | Palmer et al. | |
| 3,809,310 | A * | 5/1974 | VanderLugt, Jr. | 229/110 |

(Continued)

FOREIGN PATENT DOCUMENTS

| | | |
|---|---|---|
| GB | 09243 | 0/1909 |
| GB | 2380397 A | 9/2003 |

(Continued)

*Primary Examiner* — Gary Elkins
(74) *Attorney, Agent, or Firm* — Hoffmann & Baron, LLP

(57) ABSTRACT

The present invention relates to a container (1) comprising a wall (2) having a closed base (4) at one end and a generally circular or oval rim (5) of at an opposite end, the rim defining a top opening (6) of the container. The container (1) further comprises an arrangement of flaps (70, 80) whereby the counteracting forces between a rim of a first flap (70) and the inner face of a second flap (80) are sufficient to push the respective rim and the inner face together into a tight contact. A closure arrangement (300*a*, 300*b*) is provided to restrict flap openings (100*a*, 100*b*) formed at or below the rim (5) of the container between the flaps (70, 80) to prevent splashing and reduce the rate of spillage if the container is knocked over. The present invention thus improves the spill-resistant properties for the container (1), while, if required for drinking or pouring, permitting the container to allow the passage of a liquid when tilted for drinking and pouring.

21 Claims, 13 Drawing Sheets

(56) References Cited

U.S. PATENT DOCUMENTS

| | | | | | |
|---|---|---|---|---|---|
| D306,975 | S | * | 4/1990 | Brondyke et al. | D9/431 |
| 5,979,745 | A | * | 11/1999 | Surlina | 229/106 |
| 6,592,504 | B2 | * | 7/2003 | Sarson et al. | 493/104 |
| 7,275,652 | B2 | * | 10/2007 | Morris et al. | 220/212 |
| D596,022 | S | * | 7/2009 | van den Berg | D9/416 |
| 8,505,807 | B2 | * | 8/2013 | Herman | 229/128 |
| 8,864,015 | B2 | * | 10/2014 | Lu et al. | 229/128 |
| 2012/0292382 | A1 | * | 11/2012 | Cai et al. | 229/404 |

FOREIGN PATENT DOCUMENTS

| | | | | | |
|---|---|---|---|---|---|
| WO | 2011063835 | A1 | | 6/2011 | |
| WO | WO 2011/145752 | A1 | * | 11/2011 | B65D 3/06 |

* cited by examiner

CUP WITH INTEGRAL CLOSURE FLAPS RESTRICTING SPILLAGE

This application is a U.S. National Phase Application of, and Applicants claim priority from, International Application No. PCT/EP2013/060889, filed on May 27, 2013, which claims priority from Irish Application No. S2012/0245, filed on May 25, 2012, and which is incorporated in its entirety herein by reference.

The present invention relates to containers for cold and hot beverages or food, and in particular to disposable containers made from flexible resilient material, such as paperboard or plastics.

Known disposable containers, such as those used in fast food outlets or in vending machines usually comprise a body in the form of an inverted truncated cone having a closed base and an open top. To prevent spilling of the contents of the container, a lid is usually placed over the opening of the container. Such lids are typically moulded from a plastics material. A supply of matching lids needs to be maintained available for a user near the supply of containers at the vending location. Obviously, a lid has to be compatible with the opening of the container so as to fit securely over the rim of the container and to prevent spillage. There are a number of disadvantages associated with the use of such lids. Whilst having the same general configuration of a truncated cone, disposable containers come in different sizes and, therefore, for each container size, a different lid is normally required. Maintaining a stock of matching lids for every container size involves additional expense, requires additional storage space and managerial resources. Furthermore, it is often difficult to place even a matching lid over the container opening in a single attempt and typically some manipulation is required before the lid is finally properly put in place. Moreover, if the lid is pressed a little too hard against the rim of the container, the container can tumble and cause the contents inevitably to escape the container. Since most disposable lids are provided with a spout/opening, there still remains a relatively high risk of spillage through the spout, e.g. when a person who is carrying the container walks or manipulates other objects, such as keys, mobile phone, etc. Due to the incessant popularity of fast food services, enormous amounts of disposable containers and lids are being used and discarded all over the world on a daily basis. Whilst many disposable containers are made from paperboard, which are renewable and recyclable, lids are generally made from plastics which are far less environmentally friendly.

One known type of known container which seeks to provide an arrangement for closing a disposable container in the form of a cup is disclosed in WO201 1/063835. This known frusto-conical cup is made from a flexible resilient material, having a circular rim defining the top opening of the cup. A pair of arcuate crease lines is formed at the opposing sides of the wall of the cup below the rim defining a pair of flaps for closing the top opening of the cup by folding the flaps along the crease lines. Due to the resilience of the cup material, each flap can toggle between two stable positions on application of an initial external force on the flap, namely an open upright position in which the flap is convex and forms part of the wall of the cup, and a closed slanted position in which the flap changes its shape to concave. In the closed mode, the rim of one flap impinges against the inner face of the second flap and forms a seal between the flaps. The seal is maintained due to static opposing forces acting between the flaps. Another cup with closure flaps is disclosed in GB 2380397.

However, a problem associated with this known cup is that when the rim of one flap impinges against the inner face of the second flap there are gaps or flap openings between the flaps adjacent the ends of the crease lines, and these gaps provide openings in the seal through which the cup contents may splash or spill.

In view of the above, it is an object of the present invention to alleviate and mitigate the above disadvantages and provide an improved arrangement for a disposable container to reduce or restrict splashing and spillage of the container contents.

Accordingly, the present invention provides a container comprising a wall having a closed base at one end and a generally circular or oval rim of at an opposite end, the rim defining a top opening of the container, the container further comprising:

a pair of substantially arcuate crease lines formed in the wall of the container at opposite sides of the wall below the rim; wherein each crease line has first and second ends coinciding with the rim; wherein each crease line and the portion of the rim between the first and second ends of the crease line define a flap having an outer face and an inner face; wherein each crease line is configured to act as a hinge allowing each flap to toggle between two stable positions upon application of an initial external force on the flap, the two stable positions being an open upright position in which the flap is convex and forms part of the wall of the container, and a closed slanted position in which the flap changes its shape to concave; wherein the resilience of the flap material causes the flap to complete the toggle and prevents the flap from stopping in a position intermediate the open upright and the closed slanted positions; and the length of each crease line and the shortest distance between a point of the crease line axially most remote from the rim of the flap and the rim are selected such that when the flaps are closed, each flap assumes a slanted orientation in relation to the base of the container, whereby the rim of a first flap impinges against the inner face of the second flap whereby the second flap remains statically forced against the rim of the first flap due to the resilience of the material of the container thereby forming a seal between the rim of the first flap and the inner face of the second flap, whereby the two flaps form a double slope roof across the top opening of the container, characterised in that the container further comprises a closure arrangement operable to restrict at least one flap opening defined at or adjacent a position where the ends of the crease lines coincide with the rim of the container when the flaps are folded, wherein the closure arrangement comprises at least one wing which extends from the container wall and underneath the flap opening when the flaps are in the closed slanted position.

Due to the above described arrangement of the container of the present invention, when one of the flaps, e.g. the first flap, is allowed to move fully into the closed slanted position, whilst the second flap is prevented from moving fully into the closed slanted position by the rim of the first flap, whereby the rim of the first flap is prevented from being deformed by the second flap due to the resilience of the material of the container, so that the second flap remains statically forced against the rim of the first flap towards the closed slanted position due to the resilience of the container material. The counteracting forces between the rim of the first flap and the inner face of the second flap are sufficient to push the respective rim and the inner face together into a tight contact, but which form a seal having gaps at or adjacent where the ends of the crease lines coincide at the rim of the container, and these gaps or flap openings are problematic as they can cause spillage of the container contents.

The provision of a closure arrangement, according to the characterising portion of the invention, is operable to restrict the flap openings formed at the rim of the container when the flaps are toggled to the closed slanted position, and so provides a means to prevent or improve against splashing of the container contents and reduce the rate of spillage if the container is knocked over. The present invention thus improves the spill-resistant properties for the container, whilst, if required for drinking or pouring, permitting the container to allow the passage of a liquid when tilted for drinking and pouring.

Preferably, each wing is operable to pivot about the container wall to restrict the flap opening. Preferably, each wing extends from an inner face of the container wall.

Preferably, each wing comprises creases and/or folds.

Preferably, each wing is connected to the container by an adhesive, by an ultrasonic weld and/or with the use of heat sealing.

Preferably, each wing is integrally formed with the container.

Preferably, each wing is anchored to the container wall by an anchor tab such that the wing pivots on the anchor tab.

Preferably, the anchor tab and the wing are folded together against the container wall.

Preferably, the anchor tab is connected to the container by an adhesive, by an ultrasonic weld and/or with the use of heat sealing.

Preferably, the anchor tab is integrally formed with the container.

Preferably, the closure arrangement comprises a pair of wings, each wing extending from the container wall underneath a flap opening when the flaps are in the closed slanted position.

In an another embodiment of the invention there is provided a container comprising a wall having a closed base at one end and a generally circular or oval rim of at an opposite end, the rim defining a top opening of the container, the container further comprising:

a pair of substantially arcuate crease lines formed in the wall of the container at opposite sides of the wall below the rim; wherein each crease line has first and second ends coinciding with the rim; wherein each crease line and the portion of the rim between the first and second ends of the crease line define a flap having an outer face and an inner face; wherein each crease line is configured to act as a hinge allowing each flap to toggle between two stable positions upon application of an initial external force on the flap, the two stable positions being an open upright position in which the flap is convex and forms part of the wall of the container, and a closed slanted position in which the flap changes its shape to concave; wherein the resilience of the flap material causes the flap to complete the toggle and prevents the flap from stopping in a position intermediate the open upright and the closed slanted positions; and the length of each crease line and the shortest distance between a point of the crease line axially most remote from the rim of the flap and the rim are selected such that when the flaps are closed, each flap assumes a slanted orientation in relation to the base of the container, whereby the rim of a first flap impinges against the inner face of the second flap whereby the second flap remains statically forced against the rim of the first flap due to the resilience of the material of the container thereby forming a seal between the rim of the first flap and the inner face of the second flap, whereby the two flaps form a double slope roof across the top opening of the container, characterised in that the container further comprises a closure arrangement operable to restrict at least one flap opening defined at or adjacent a position where the ends of the crease lines coincide with the rim of the container when the flaps are folded, in which the closure arrangement comprises at least one tab for restricting a flap opening, wherein each tab is located at a region of the container where the ends of the crease lines coincide with the rim of the container, and wherein when the flaps are toggled into the closed slanted position each tab pivots about a fold line so that portions of the tab either side of the fold line which project above the rim of the container are folded together and restrict the flap opening.

Preferably, each tab projects from the rim of the container when the flaps are in the open upright position.

Preferably, each tab projects substantially upright from the rim of the container when the flaps are in the open upright position.

Preferably, each tab is fixed to the container by an adhesive, by an ultrasonic weld and/or with the use of heat sealing.

Preferably, each tab is integrally formed with the container.

Preferably, each tab comprises an inner face and an outer face, wherein an adhesive is provided on the inner face.

Preferably, the closure arrangement comprises a pair of tabs, each tab for restricting a flap opening.

Preferably, the container is made from a flexible resilient material.

Preferably, each tab is substantially rectangular shaped. Alternatively, each tab is substantially round, oval, polygonal or irregular in shape.

Preferred materials for the container are flexible resilient materials such as paperboard or plastics, the paperboard being a more preferred material due to its ability to be recycled.

Preferably, the container is a cup. Alternatively, the container is a jug, a carton or a vessel for drinking or for carrying or storing a liquid, semi-solid or solid contents.

It will be appreciated that the terms “inner”, “inwardly”, “outer”, “outwardly”, “axially”, “longitudinally” or similar are used in relation to a central axis of the cone. Accordingly, the terms “convex” and “concave” are to be understood as, respectively, “bent outwardly and inwardly in relation to the central axis”. It will also be appreciated that the terms “up”, “upper” “upright”, “down”, “lower” downward” and “slanted” are used in relation to the base of the container.

The invention will now be described with reference to the accompanying drawings which show, by way of example only, embodiments of a container formed as a cup according to the invention. In the drawings.

Figure 3:
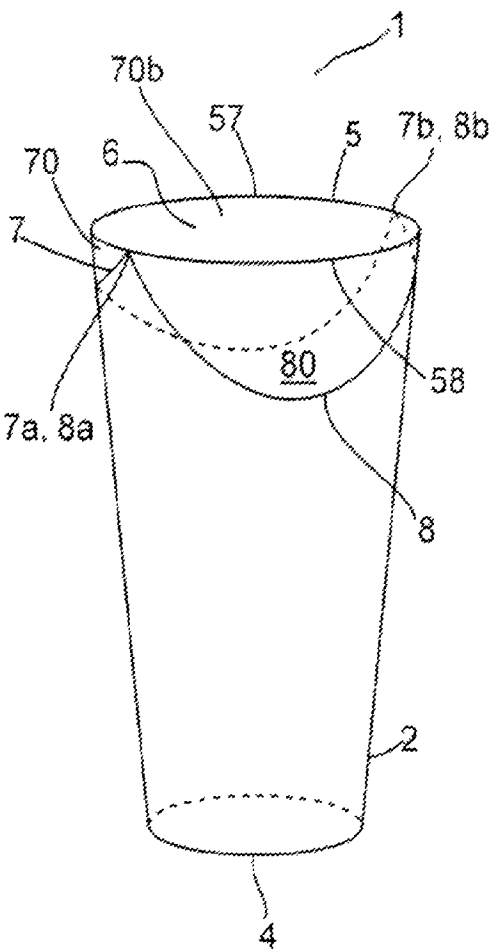
Fig. 3 (PRIOR ART)
FIGS. 1 to 7 are side and perspective views of a container formed as a cup according to the prior art.
Figure 2:
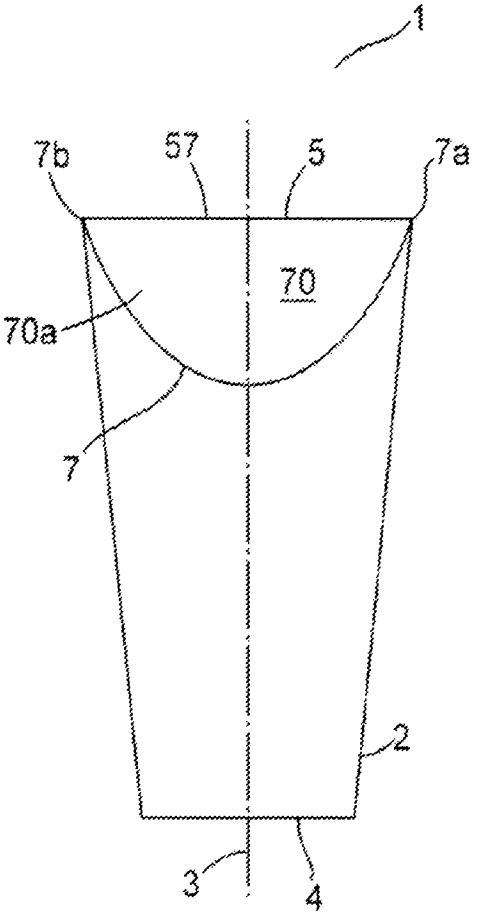
Fig. 2 (PRIOR ART)

In the following description the features of the present invention will be described as they relate to a container embodied as a cup. However, it will be understood that other embodiments for a container are also envisaged, such as a jug, a carton, and a vessel for drinking or for carrying or storing a liquid, a semi-solid or solid contents, and that therefore reference in the following description to a container formed as a cup only should in no way be seen as limiting.

Referring initially to FIGS. 1 to 7, a cup in accordance with the prior art is indicated generally by reference numeral 1. The cup 1 is made from a flexible resilient material, such as paperboard or a plastics material.

The cup 1 has a wall 2 having a shape of a truncated cone having a central axis 3, a closed base 4 of an optionally smaller diameter at one end and a generally circular rim 5 of optionally larger diameter at an opposite end. It will be appreciated that the invention is not limited to a circular cross-section of the cup wall. Indeed, a generally oval cross-section of the cup is within the scope of the present invention. It is also within the scope of the present invention to have a protruding spout or drinking opening. The rim 5 defines a top opening 6 of the cup 1. The rim 5 and base 4 may also be of the same diameter.

Figure 7:
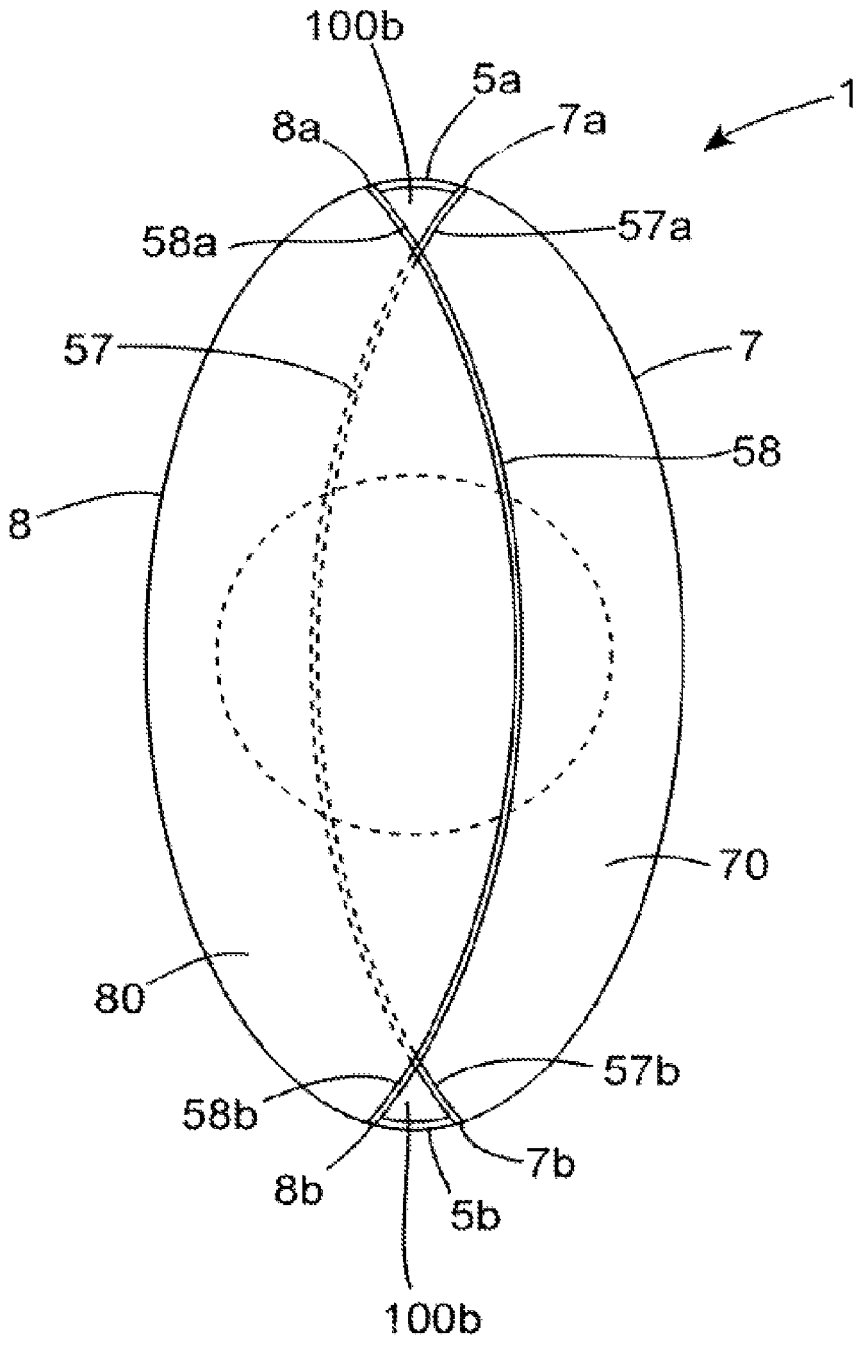
Fig. 7 (PRIOR ART)

A pair of substantially arcuate crease lines 7, 8 is formed in the wall 2 of the cup 1 at opposite sides of the wall 2 below the rim 5. Each crease line 7, 8 has first and second ends 7*a*, 8*a* and 7*b*, 8*b*, respectively. The ends of the crease lines 7*a*, 8*a*, 7*b*, 8*b* coincide with the rim 5. Also, each end 7*a*, 7*b* of a first crease line 7 substantially coincides with a corresponding end 8*a*, 8*b* of the second crease line 8 on the rim 5 of the cup, although it will be understood that to provide a container having a drinking or pouring spout or funnel the ends 7*a*, 7*b*, 8*a*, 8*b* of the crease lines 7, 8 may not fully coincide with each other at the rim 5 so as to create a sufficiently wide opening at the rim 5, as shown in FIG. 7 by gaps 5*a*, 5*b*, thereby creating a drinking or pouring funnel or opening 100*a*, 100*b*

Each crease line 7, 8 and the respective portion 57, 58 of the rim 5 between the respective first and second ends 7*a*, 7*b*; 8*a*, 8*b* of the crease line 7, 8 define a flap 70, 80, respectively. Each flap 70, 80 has an outer face 70*a*, 80*a* and an inner face 70*b*, 80*b*, respectively.

Figure 1:
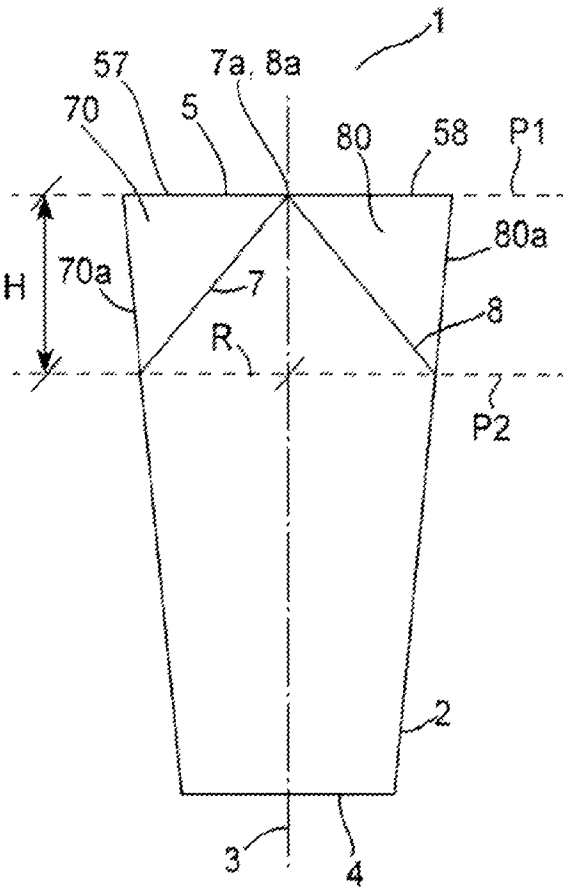
Fig. 1 (PRIOR ART)
Figure 5:
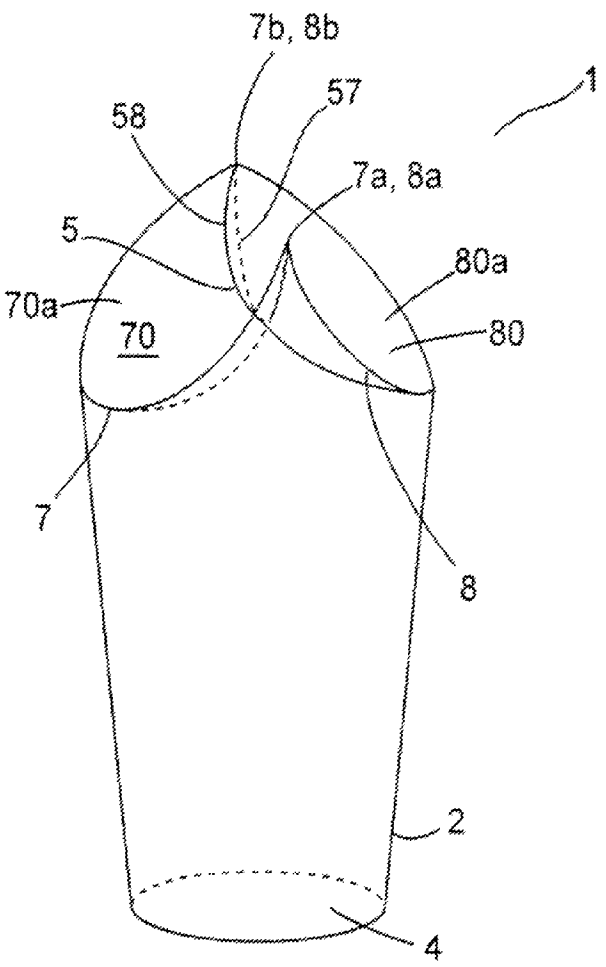
Fig. 5 (PRIOR ART)
Figure 4:
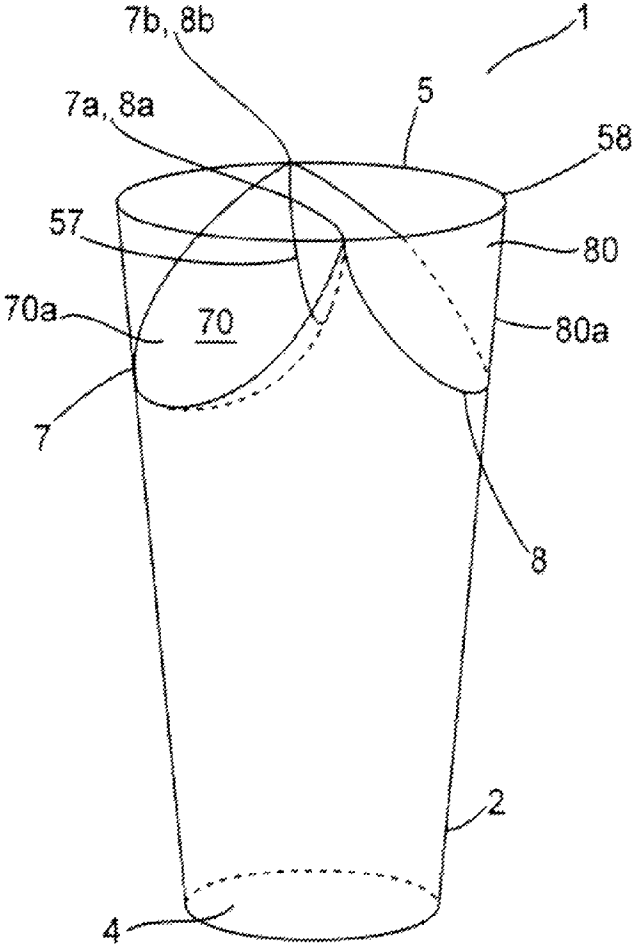
Fig. 4 (PRIOR ART)

Each crease line 7, 8 is configured using a suitable method (e.g. by bending, scoring or differential forming, such as in the case of plastic cups, the material of the wall 2) to act as a hinge to allow each flap 70, 80 to toggle between two stable positions upon application of an initial external force on the flap 70, 80. One of the two stable positions is an open upright position in which the flap 70, 80 is convex and forms part of the wall 2 of the cup, for example, as shown in FIG. 1. The second of the two stable positions is a closed slanted position in which the flap 70, 80 changes its shape to concave, for example, as shown in FIGS. 4 and 5. A flap 70, 80 is prevented from remaining in a position intermediate the open upright and the closed slanted positions due to the resilience of its material and because in an intermediate position the flap 70, 80 becomes distorted, e.g. corrugated, because the length of the flap 70, 80 in the circumferential directions is greater the length of a plane defined by the respective crease line 7, 8. When pushed into an intermediate position by an external force and upon subsequent removal of the external force, the flap 70, 80 assumes either the concave shape in the closed slanted position or the convex shape in the open upright position under the influence of the inherent resilience of the cup material. The resilience of the cup material causes the flap 70, 80 to complete the toggle without the need for the continued application of the external force and prevents the flap 70, 80 from stopping in a position intermediate the open upright and the closed slanted positions.

Figure 6:
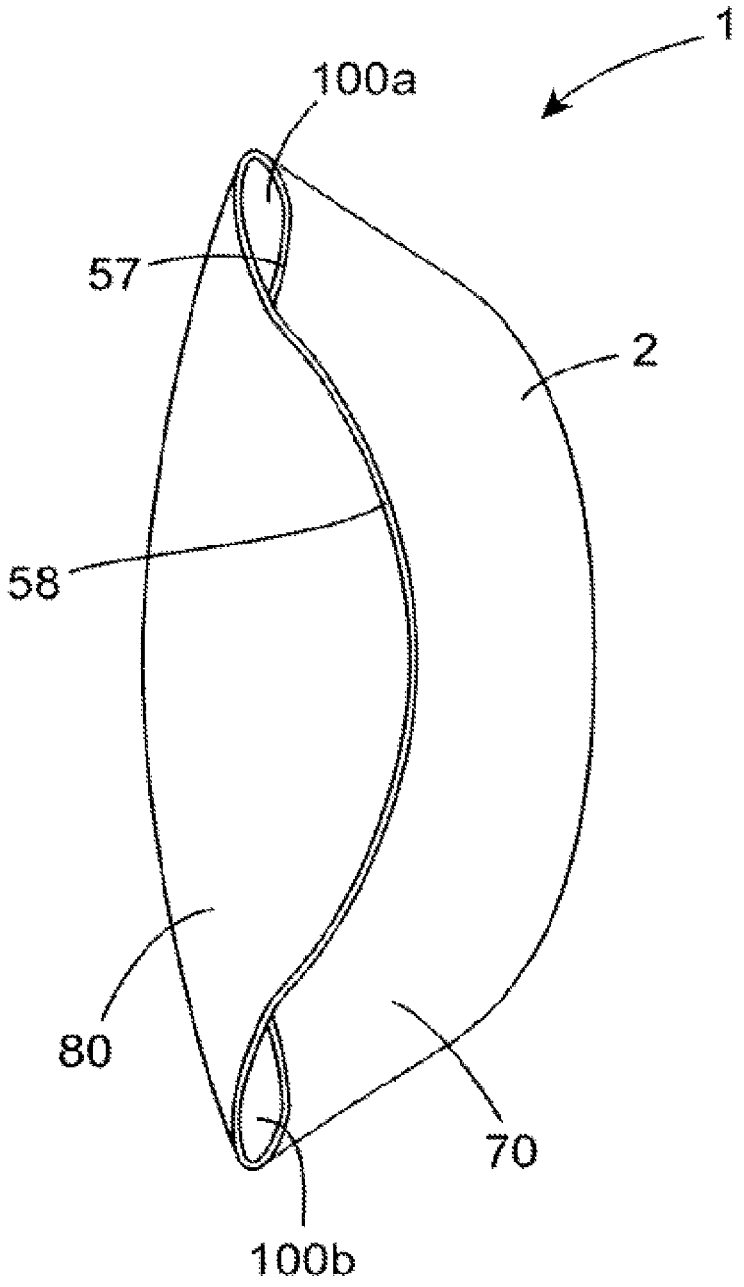
Fig. 6 (PRIOR ART)

The length of each crease line 7, 8 and the distance between points P1 and P2, as shown in FIG. 1, respectively, of the crease line 7, 8 axially most remote from the rim 57, 58 of the flap 70, 80 and the rim 5 are such that when the flaps 70, 80 are closed, each flap 70, 80 assumes a slanted, curved and/or angled orientation in relation to the base 4 of the cup 1. Furthermore, a first flap, e.g. flap 70, is allowed to move fully into the closed slanted position as shown in FIG. 4. The second flap, i.e. flap 80, is prevented from moving fully into the closed slanted position by the rim 57 of the first flap which impinges against the inner face 80*b* of the second flap 80 substantially along the full length of the rim 57 of the first flap 70. The rim 57 of the first flap 70 is prevented from being deformed by the second flap 80 due to the resilience of the material of the first flap 70 (i.e. the material of the cup 1), while the second flap 80 remains statically forced against the rim 57 of the first flap 70 towards the fully closed slanted position due to the resilience of the material of the second flap 80 (i.e. the material of the cup 1), as shown in FIG. 5. Due to the continuous forced contact between the rim 57 of the first flap 70 and the inner face 80*b* of the second flap 80, a spill-tight seal is formed along the length of the rim 57 of the first flap 70. As shown in FIGS. 5 to 7, the two flaps 70, 80 form a double-slope roof across the top opening 6 of the cup 1.

However, a problem associated with this known cup 1 is that when the rim 57 of flap 70 impinges against the inner face 80*b* of the second flap 80 that there are noticeable gaps or flap openings 100*a*, 100*b* located near the ends 57*a*, 57*b*, 58*a*, 58*b* of the rim 57, 58 where the ends of the crease lines 7*a*, 8*a* and 7*b*, 8*b* coincide with the cup rim 5*a*, 5*b*, and these openings provide an outlet in the seal causing spillage of the contents of the cup 1. Accordingly, the present invention now provides a closure arrangement to restrict the flap openings 100*a*, 100*b* to thereby prevent or improve against splashing of the container contents and reduce the rate of spillage if the container is knocked over. The present invention thus improves the spill-resistant properties for the container, whilst, if required for drinking or pouring, permitting the container to allow the passage of a liquid when tilted for drinking and pouring. It will be understood that the ends of the crease lines 7*a*, 8*a* and 7*b*, 8*b* may not coincide with the rim 5 in order as to create a sufficiently wide opening at the rim 5 for the formation of a drinking and/or pouring spout or funnel.

Figure 8:
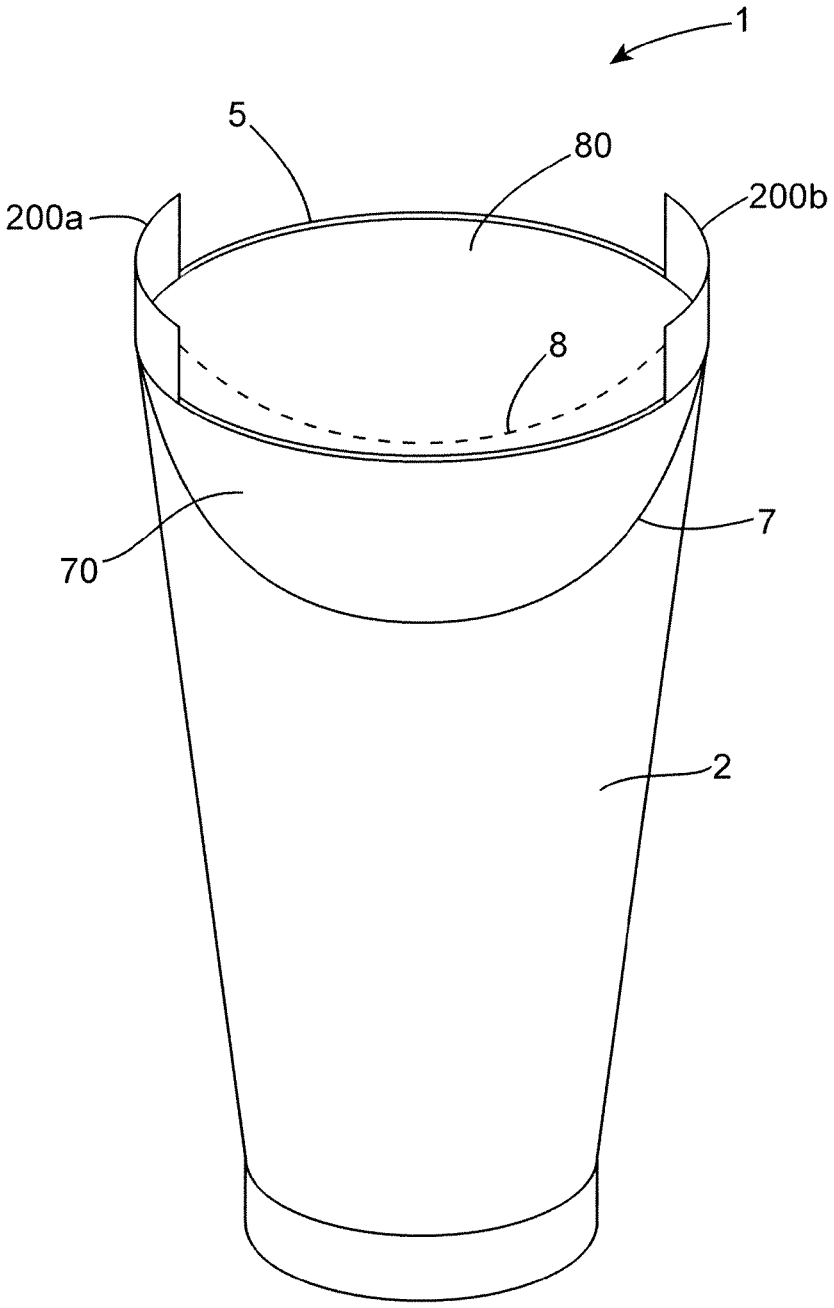
FIG. 8 is a perspective view of a container formed as a cup showing a closure arrangement according to an embodiment of the invention.
Figure 9:
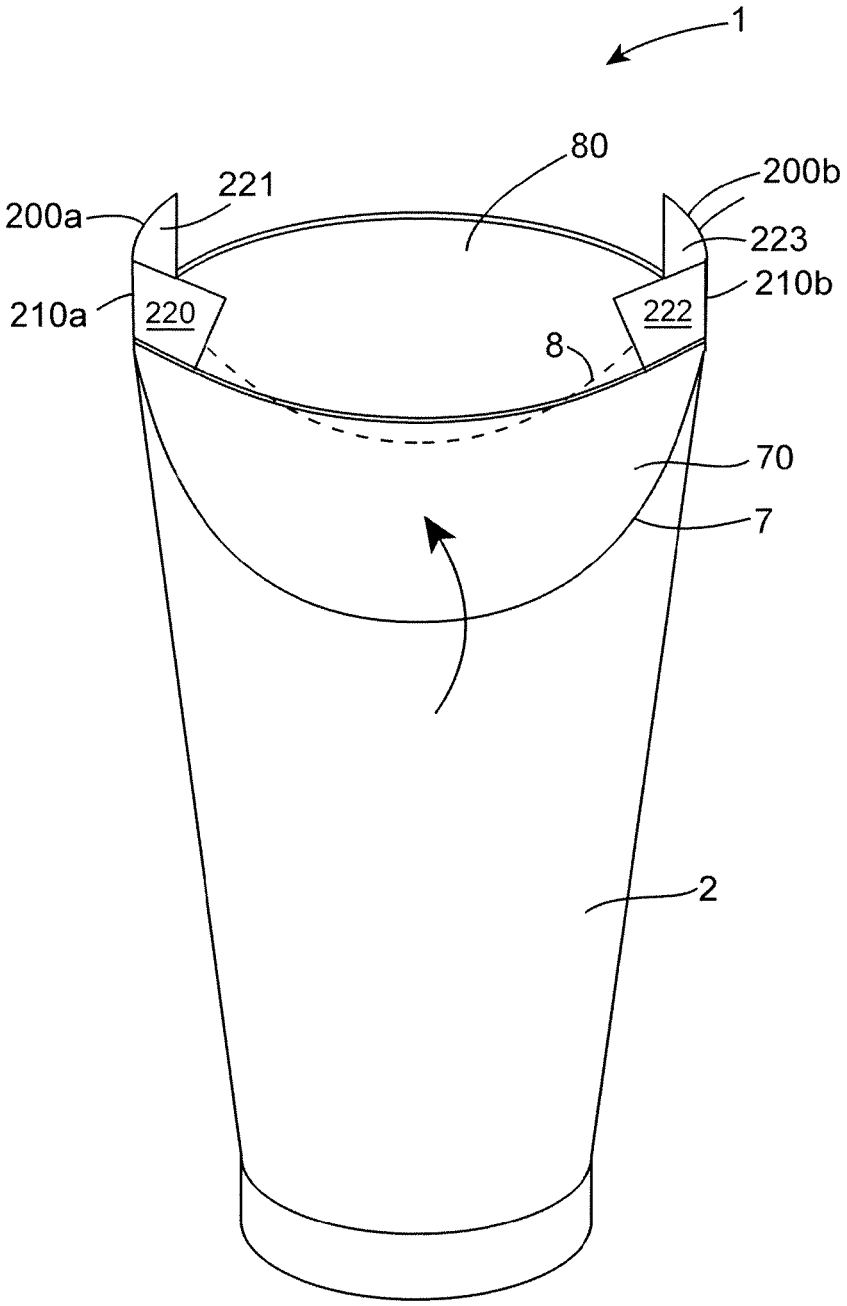
FIG. 9 is a perspective view of a partially closed cup of FIG. 8.
Figure 10:
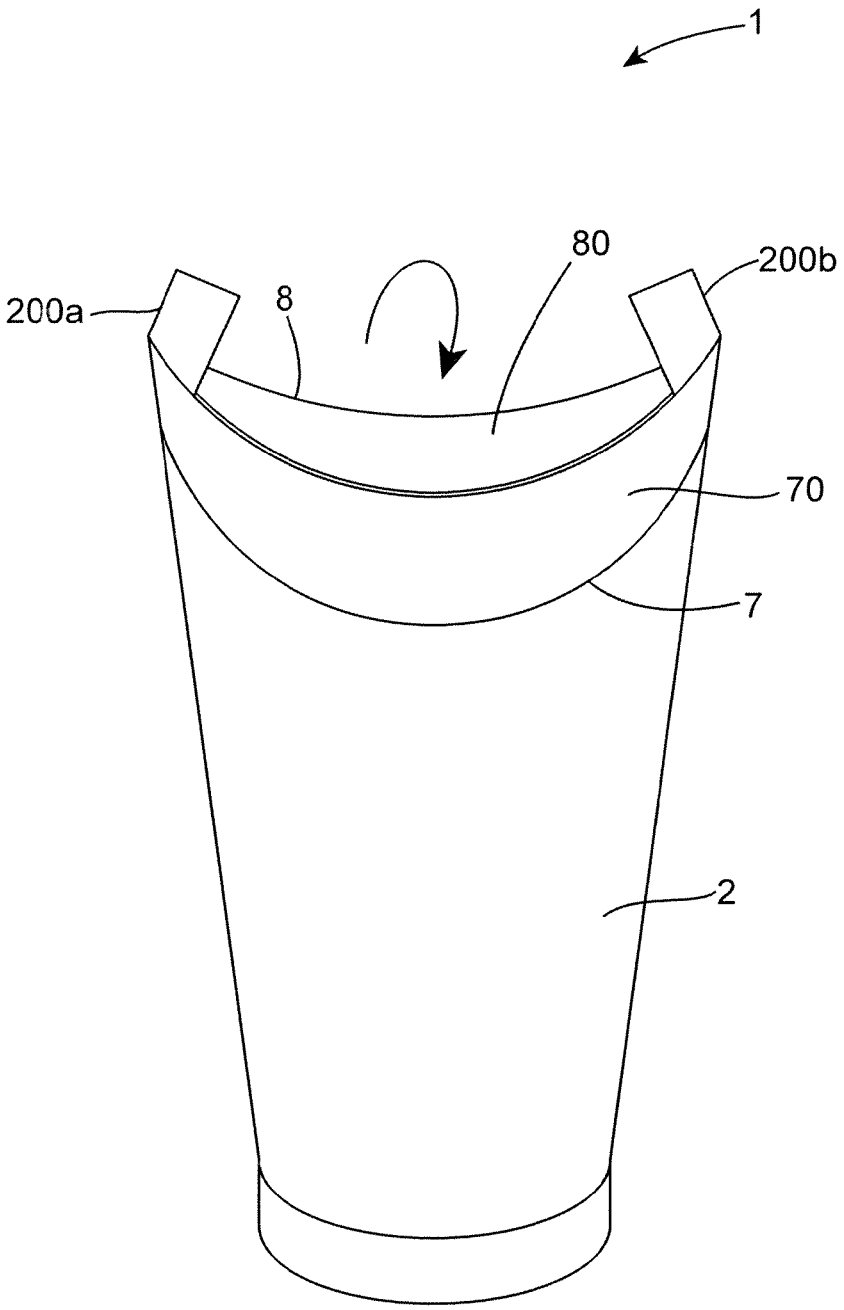
FIG. 10 is a perspective view of a fully closed cup of FIG. 8.
Figure 11:
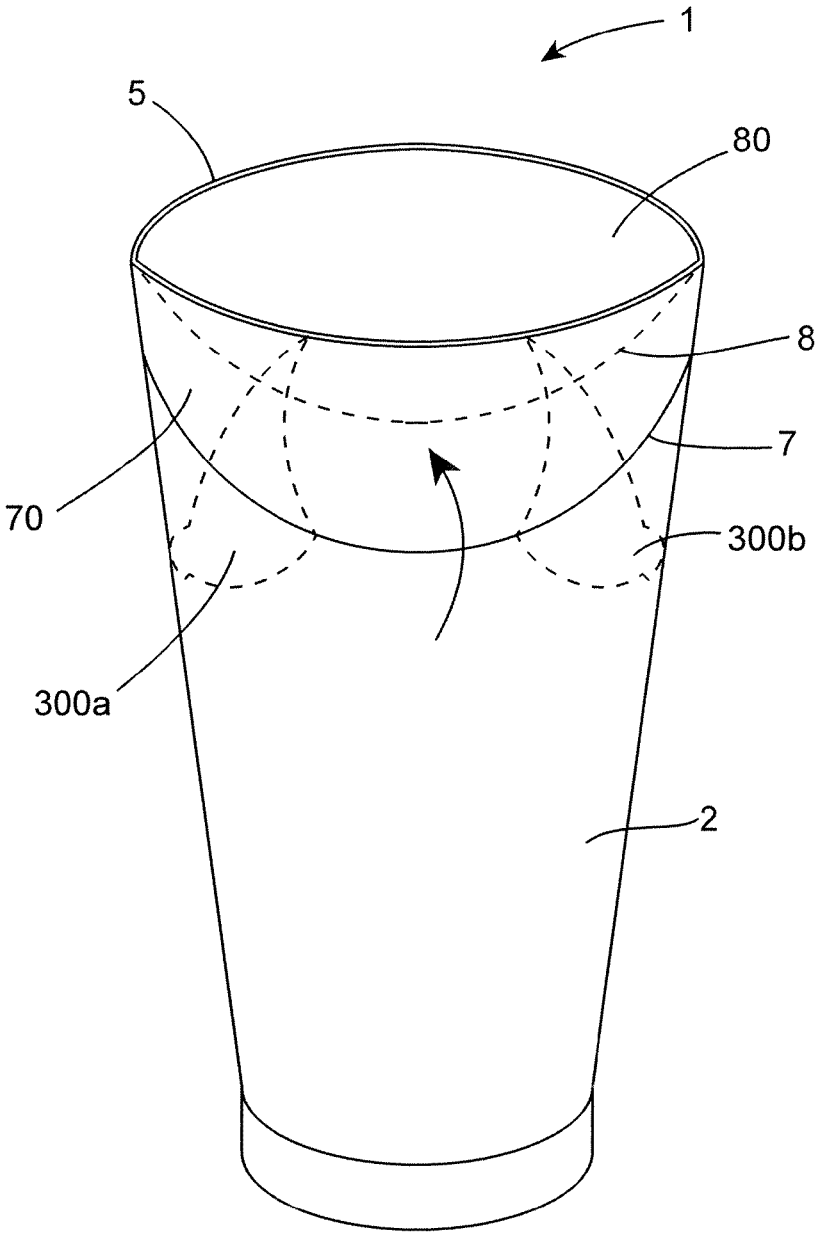
FIG. 11 is a perspective view of a container formed as a cup showing a closure arrangement according to another embodiment of the invention.
Figure 12:
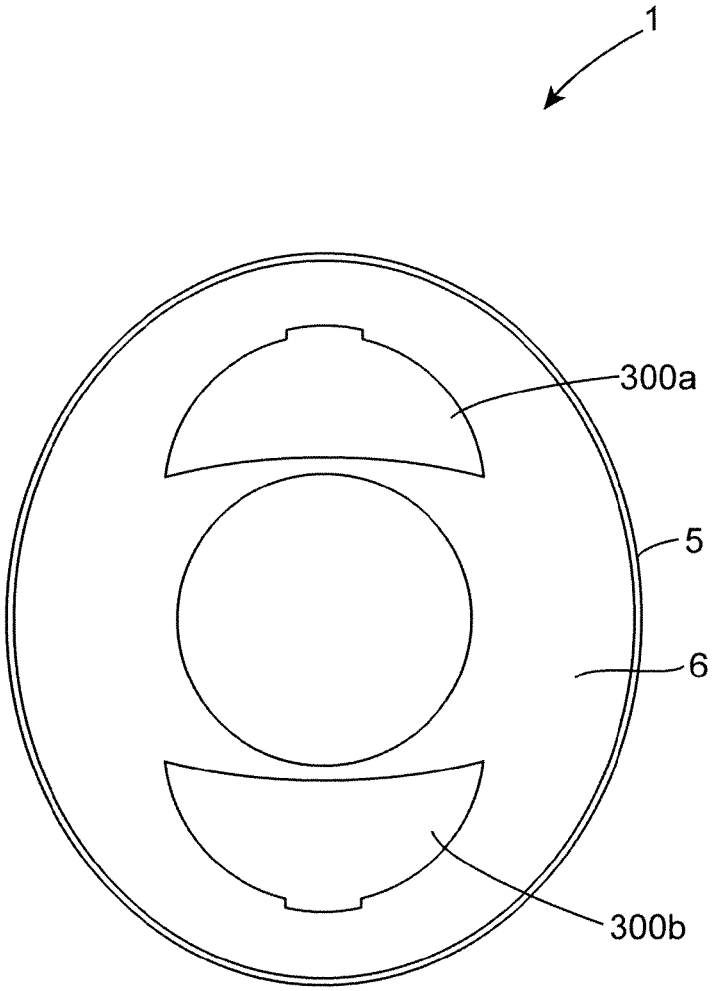
FIG. 12 is a plan view of the cup of FIG. 11.
Figure 13:
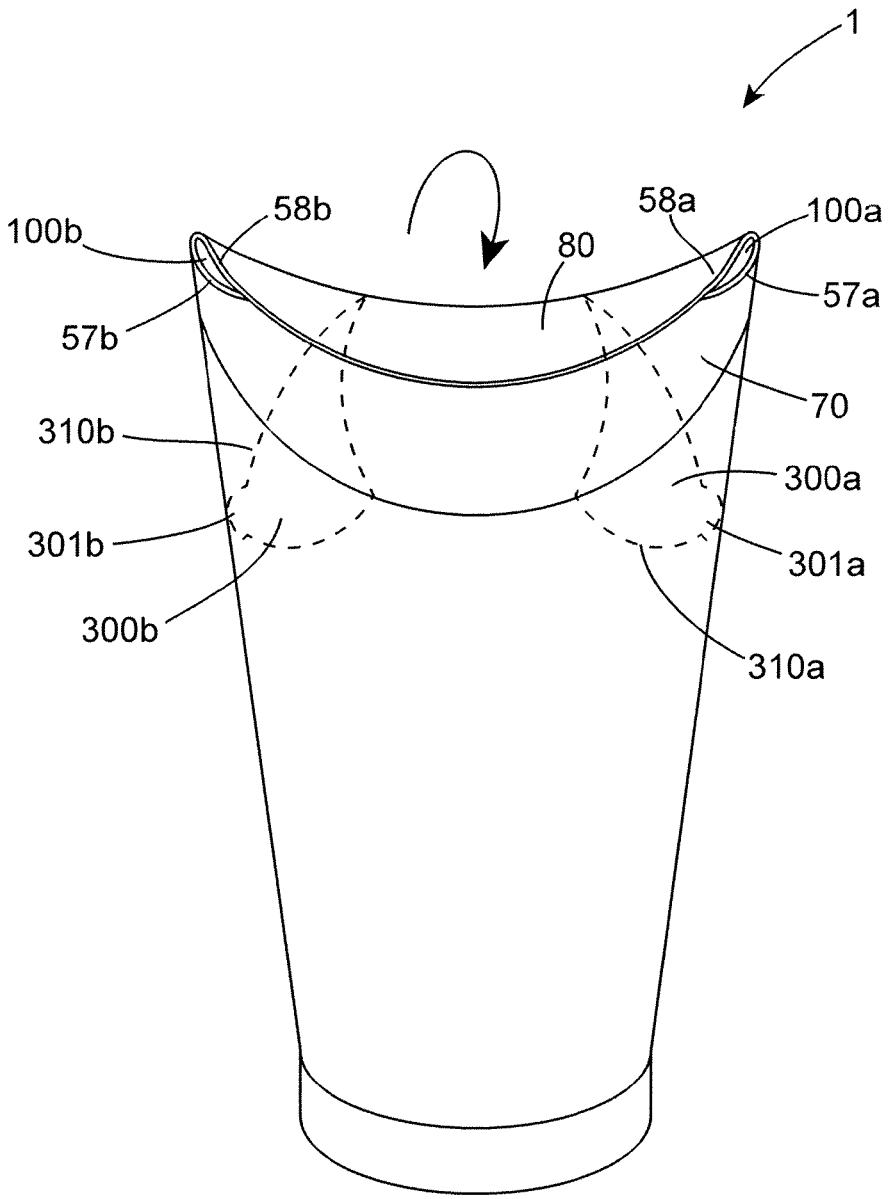
FIG. 13 is a perspective view of a fully closed cup of FIG. 11.
Figure 14:
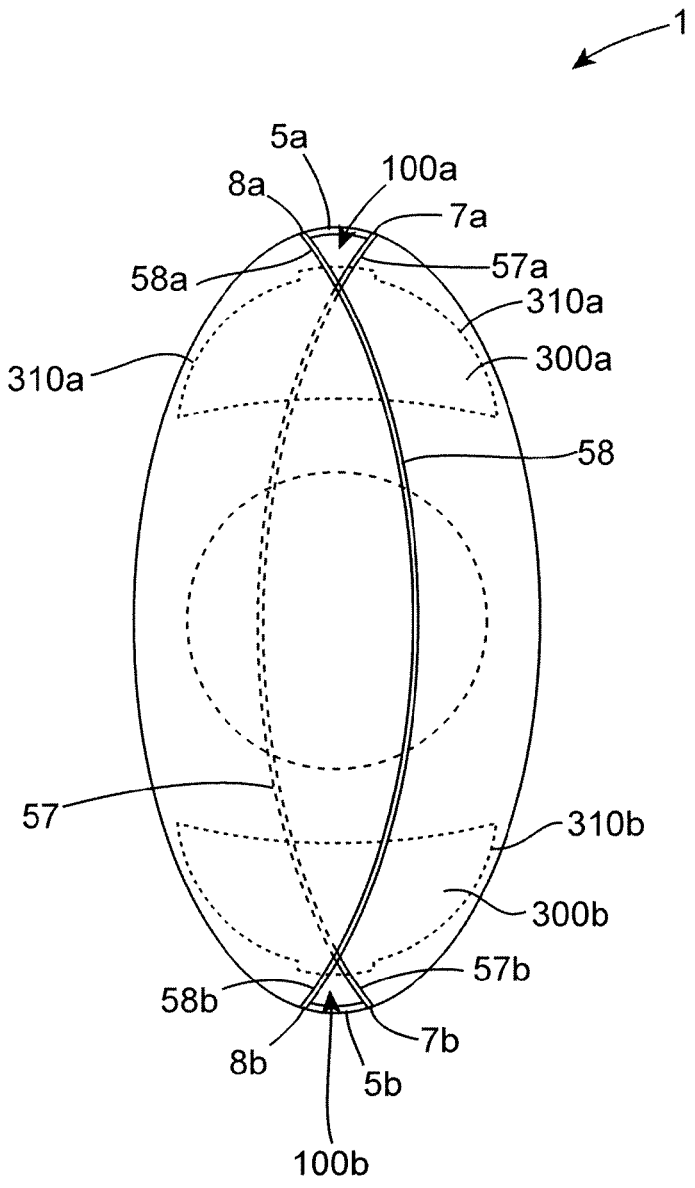
FIG. 14 is a plan view of FIG. 13.

Referring now to FIGS. 8 to 10, in one configuration of the invention, the closure arrangement comprises at least one tab 200*a* and/or 200*b* each for restricting one of the gaps or flap openings 100*a*, 100*b* formed in the seal when the flaps 70, 80 are folded. Although two tabs 200*a*, 200*b* are shown in the drawings to restrict both flap openings 100*a*, 100*b*, it will be understood that the cup container may require only a single tab where a single flap opening is to be sealed. For example, and depending on the specific application of the invention, it may be desirable to allow the container contents to have an unimpeded flow through one of the two flap openings, and to restrict flow through the other of the two flap openings, in which case the inclusion of a tab to restrict of the flap openings would be required. Reference to the use of a pair of tabs should therefore in no way be seen as limiting.

Each tab 200*a*, 200*b* is located on the cup where the ends 7*a*, 7*b*, 8*a*, 8*b* of the crease lines 7, 8 coincide with the rim 5*a*, 6*b* of the cup 1. As shown, each tab 200*a*, 200*b* projects from the rim 5*a*, 5*b* of the cup 1 when the flaps 70, 80 are in the open upright position. The tabs are fixed to the cup by an adhesion using heat, ultrasonic welds or other suitable connection methods. The tabs may also be integrally formed when the cup is made.

Toggling the flaps 70, 80 towards the closed slanted position causes the formation of fold lines 210*a*, 210*b* in the tabs 200*a*, 200*b*. As the flaps 70, 80 are toggled into the final closed slanted, curved and/or angled position each tab 200*a*, 200*b* pivots about its respective fold line 210*a*, 210*b* so that portions 220, 221, 222, 223 of the tab 220*a*, 220*b* either side of the fold line 210*a*, 210*b* which project above the rim 5 of the cup 1 are folded together causing the openings 100*a*, 100*b* to be restricted by the tabs. Thus in the arrangement shown, portion 220 seals against portion 221 and portion 222 seals against portion 223. In some arrangements, when the tab portions 220, 221 are sealed together it is operable to cause the ends 57*a* and 58*a* of the rim 57, 58 to close together and restrict or in some instances completely seal the flap opening 100*a*. Similarly, when the tab portions 222, 223 are sealed together it may cause the ends 57*b* and 58*b* to close together and restrict or in some instances seal the flap opening 100*b*.

Each tab 200*a* and 200*b* also comprise an inner face and an outer face, wherein an adhesive is provided on the inner face to further enhance the restricting effect of the closure arrangement. As shown each tab 220*a* is substantially rectangular in shape, but it will be understood that the tabs may be any shape as required to fulfil the function described above. For example, the tabs 200*a*, 200*b* may be substantially round, oval, polygonal or irregularly shaped. Accordingly, a closure arrangement comprising such tabs 200*a*, 200*b* are operable to restrict or cover the openings 100*a*, 100*b*.

Referring now to FIGS. 11 to 16, there is shown a closure arrangement according to a further embodiment of the invention, the closure arrangement comprising a pair of wings 300*a*, 300*b*, each wing for restricting one of the flap openings 100*a*, 100*b* formed in the seal when the flaps 70, 80 are folded. Although two wings 300*a*, 300*b* are shown in the drawings to restrict both flap openings 100*a*, 100*b* it will be understood that the cup container 1 may, depending on the specific application of the invention, require only a single wing to be used when only one of the flap openings is desired to be restricted. Reference to the use of a pair of wings should therefore not be seen as limiting.

As shown in FIGS. 11 to 16, each wing 300*a*, 300*b* extends from the cup wall 2 underneath the flaps 70, 80 when the flaps 70, 80 are in the folded or closed slanted, curved and/or angled position. Each wing extends from an inner face of the cup wall underneath the opening 100*a*, 100*b* it restricts and is optionally anchored to the inner cup wall by a tab 301*a*, 301*b* about which the respective wing 300*a*, 300*b* may pivot.

Figure 15:
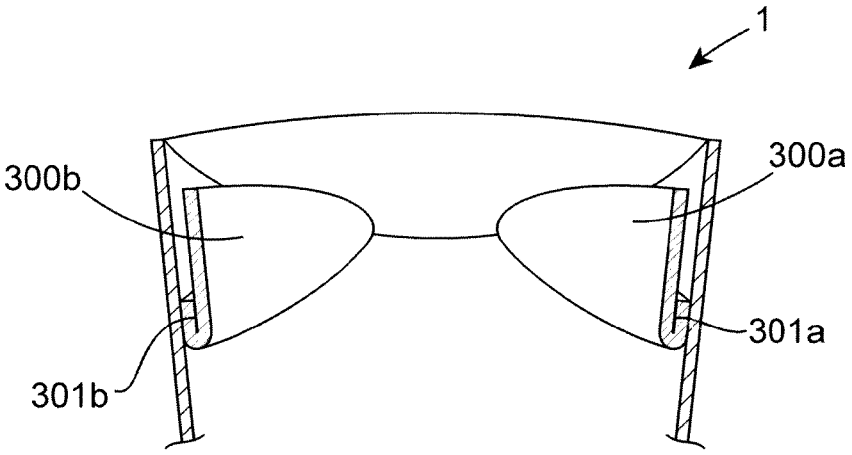
FIG. 15 is a sectional view showing an alternative embodiment of the closure arrangement of the cup of FIG. 11.
Figure 16:
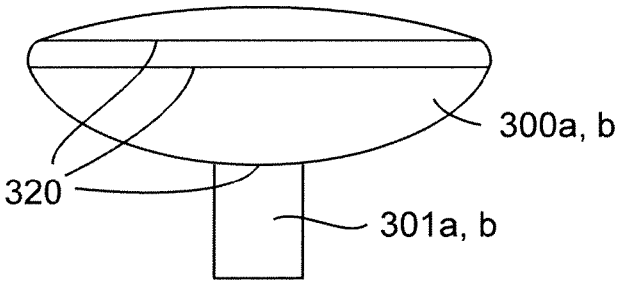
FIG. 16 is a plan view of a wing used in the closure arrangement of FIG. 15.

As shown in FIG. 15, the wing 300*a*, 300*b* and/or anchor tab 301*a*, 301*b* may be folded. This feature reduces the pressure required to push the wing down into the closed position as the wing is essentially folded back on itself and is predisposed to turn down when pressured. The wings 300*a*, 300*b* and/or anchor tabs 301*a*, 301*b* may also be straight, rather than folded. As shown in FIG. 16, the wings 300*a*, 300*b* may have crease lines 320 to add strength to the wings in order to make them easier to push without the outer edges buckling under pressure.

In use, the wings 300*a*, 300*b* are shaped to restrict the openings 100*a*, 100*b* from within the cup 1 reduce splashing of the container contents. The wings 300*a*, 300*b* may be shaped such that edges 310*a*, 310*b* of the wings 300*a*, 300*b* engage against the inner face of the cup wall 2 to further ensure that the contents of the cup do not leak out of the openings 100*a*, 100*b*. Accordingly, a closure arrangement comprising such wings 300*a*, 300*b* are operable to restrict or in some instances seal the flap openings 100*a*, 100*b* to reduce splashing and reduce the rate of spillage if the container is knocked over. The present invention thus improves the spill-resistant properties for the container, whilst, if required for drinking or pouring, permitting the container to allow the passage of a liquid when tilted for drinking and pouring.

Although the wings 300*a*, 300*b* are shown as being substantially semi-circular in shape, it will be understood that they may be any suitable shape as required or desired, and may be adapted to have a shape specifically suited to the shape of the container 1 and the function that is to be performed. For example, the wings 300*a*, 300*b* may be substantially round, oval, polygonal or irregular shaped as needed. The wings are made of the same material as the container, or may alternatively be made of a heavier gauge material for additional strength.

Figure 17:
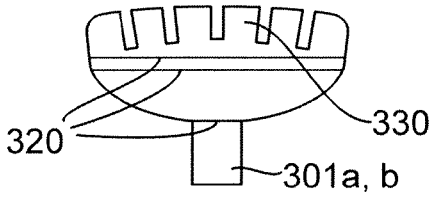
FIG. 17 is a plan view of an alternative wing to that shown in FIG. 16.

Referring to FIG. 17, a comb type edge 350 may be provided along the upper edge of the wings 300*a* and 300*b* as shown in FIG. 16. The comb type edge 350 helps to neutralise the energy of upward splashes from the inside of the container and deflect them while not restricting liquid flow.

Figure 18:
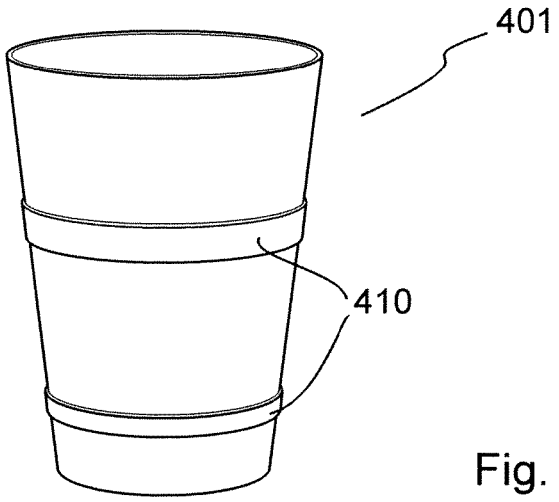
FIGS. 18 and 19 are perspective views of two further embodiments of containers in the form of cups according to the invention.
Figure 19:
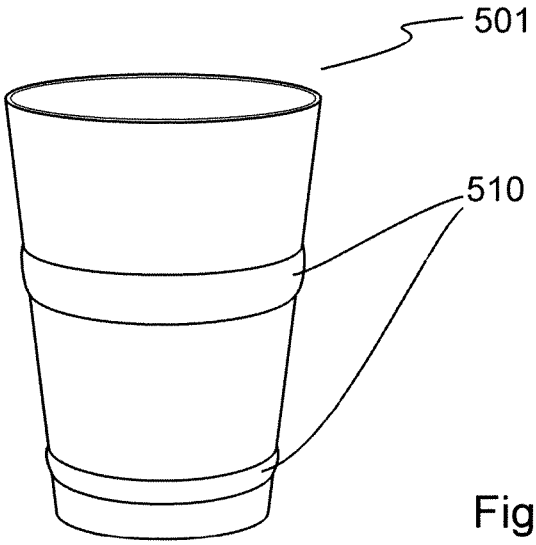

An alternative embodiment of cup 401 is shown in FIG. 18 and includes one or more circular bands 410 of paperboard around the periphery of the cup. The band or bands 410 will add strength to the structure of the cup, using an optimal amount of paperboard relative to the desired structural strength. In a double wall cup these bands would not be visible. A further variation of this embodiment is shown in FIG. 19, in which cup 501 alternatively includes crease lines, grooves or ribs 510 provident in the wall of the cup instead of the bands 410.

It will be appreciated by those skilled in the art that variations and modifications can be made without departing from the scope of the invention as defined in the appended claims.

The invention claimed is:

1. A container comprising a wall having a closed base at one end and a generally circular or oval rim of at an opposite end, the rim defining a top opening of the container, the container further comprising:

a pair of substantially arcuate crease lines formed in the wall of the container at opposite sides of the wall below the rim; wherein each crease line has first and second ends coinciding with the rim; wherein each crease line and the portion of the rim between the first and second ends of the crease line define a flap having an outer face and an inner face; wherein each crease line is configured to act as a hinge allowing each flap to toggle between two stable positions upon application of an initial external force on the flap, the two stable positions being an open upright position in which the flap is convex and forms part of the wall of the container, and a closed slanted position in which the flap changes its shape to concave; wherein the resilience of the flap material causes the flap to complete the toggle and prevents the flap from stopping in a position intermediate the open upright and the closed slanted positions; and the length of each crease line and the shortest distance between a point of the crease line axially most remote from the rim of the flap and the rim are selected such that when the flaps are closed, each flap assumes a slanted orientation in relation to the base of the container, whereby the rim of a first flap impinges against the inner face of the second flap whereby the second flap remains statically forced against the rim of the first flap due to the resilience of the material of the container thereby forming a seal between the rim of the first flap and the inner face of the second flap, whereby the two flaps form a double slope roof across the top opening of the container, characterised in that the container further comprises a closure arrangement operable to restrict at least one flap opening defined at or adjacent positions where the ends of each crease line coincide with the rim of the container when the flaps are folded, wherein the closure arrangement comprises at least one wing which extends from a location on the container wall downwardly spaced from the flap opening and underneath the flap opening when the flaps are in the closed slanted position, wherein the flap opening remains open for passage of a liquid when the container is tilted, enabling drinking or pouring from the container.

2. A container as claimed in claim 1, wherein each wing is operable to pivot about the container wall to restrict the flap opening.

3. A container as claimed in claim 1, wherein each wing comprises creases and/or folds.

4. A container as claimed in claim 1, wherein each wing is connected to the container by an adhesive, by an ultrasonic weld and/or with the use of heat sealing.

5. A container as claimed in claim 1, wherein each wing is integrally formed with the container.

6. A container as claimed in claim 1, wherein each wing is anchored to the container wall by an anchor tab such that the wing pivots on the anchor tab.

7. A container as claimed in claim 6, wherein the anchor tab and the wing are folded together against the container wall.

8. A container as claimed in claim 6, wherein the anchor tab is connected to the container by an adhesive, by an ultrasonic weld and/or with the use of heat sealing.

9. A container as claimed in claim 6, wherein the anchor tab is integrally formed with the container.

10. A container as claimed in claim 1, in which the closure arrangement comprises a pair of wings, each wing extending from the container wall underneath a flap opening when the flaps are in the closed slanted position.

11. A container as claimed in claim 1, which is made from a flexible resilient material.

12. A container as claimed in claim 1, in which a comb type edge is provided along the upper edge of the or each wing.

13. A container as claimed in claim 1, in which strengthening means are provided on the periphery of the wall of the container.

14. A container as claimed in claim 13 in which the strengthening means is selected from the group comprising bands, crease lines, grooves and ribs.

15. A container comprising a wall having a closed base at one end and a generally circular or oval rim of at an opposite end, the rim defining a top opening of the container, the container further comprising:

a pair of substantially arcuate crease lines formed in the wall of the container at opposite sides of the wall below the rim; wherein each crease line has first and second ends coinciding with the rim; wherein each crease line and the portion of the rim between the first and second ends of the crease line define a flap having an outer face and an inner face; wherein each crease line is configured to act as a hinge allowing each flap to toggle between two stable positions upon application of an initial external force on the flap, the two stable positions being an open upright position in which the flap is convex and forms part of the wall of the container, and a closed slanted position in which the flap changes its shape to concave; wherein the resilience of the flap material causes the flap to complete the toggle and prevents the flap from stopping in a position intermediate the open upright and the closed slanted positions; and the length of each crease line and the shortest distance between a point of the crease line axially most remote from the rim of the flap and the rim are selected such that when the flaps are closed, each flap assumes a slanted orientation in relation to the base of the container, whereby the rim of a first flap impinges against the inner face of the second flap whereby the second flap remains statically forced against the rim of the first flap due to the resilience of the material of the container thereby forming a seal between the rim of the first flap and the inner face of the second flap, whereby the two flaps form a double slope roof across the top opening of the container, characterised in that the container further comprises a closure arrangement operable to restrict at least one flap opening defined at or adjacent positions where the ends of each crease line coincide with the rim of the container when the flaps are folded, in which the closure arrangement comprises at least one tab for restricting the flap opening, wherein the at least one tab is located at a region of the container where the at least one flap opening is defined at or adjacent the positions where the ends of each crease line coincide with the rim of the container, and wherein when the flaps are toggled into the closed slanted position each tab pivots about a fold line so that portions of the tab on either side of the fold line which project above the rim of the container are folded together above the flap opening and restrict the flap opening.

16. A container as claimed in claim 15, wherein each tab projects from the rim of the container when the flaps are in the open upright position.

17. A container as claimed in claim 15, wherein each tab projects substantially upright from the rim of the container when the flaps are in the open upright position.

18. A container as claimed in claim 15, wherein each tab is fixed to the container by an adhesive, by an ultrasonic weld and/or with the use of heat sealing.

19. A container as claimed in claim 15, wherein each tab is integrally formed with the container.

20. A container as claimed in claim 15, wherein each tab comprises an inner face and an outer face, wherein an adhesive is provided on the inner face.

21. A container as claimed in claim 15, in which the closure arrangement comprises a pair of tabs, each tab for restricting a flap opening.

* * * * *